United States Patent [19]

Fenton

[11] 3,988,997

[45] Nov. 2, 1976

[54] BOAT FENDER

[76] Inventor: Leonard Fenton, 24761 Maidstone Lane, Beachwood, Ohio 44122

[22] Filed: Mar. 4, 1976

[21] Appl. No.: 663,922

[52] U.S. Cl. ..... 114/219
[51] Int. Cl.[2] ..... B63B 59/02
[58] Field of Search ..... 114/219; 61/48; 267/139, 140

[56] References Cited

UNITED STATES PATENTS

| | | | |
|---|---|---|---|
| 1,361,902 | 12/1920 | Porteous | 114/219 |
| 2,028,060 | 1/1936 | Gilbert | 114/219 |
| 2,960,055 | 11/1960 | Tomek | 61/48 |
| 3,292,566 | 12/1966 | Russell | 114/219 |

*Primary Examiner*—Trygve M. Blix
*Assistant Examiner*—Stuart M. Goldstein
*Attorney, Agent, or Firm*—McNenny, Pearne, Gordon, Gail, Dickinson & Schiller

[57] ABSTRACT

An inflatable, weighted boat fender is disclosed which is particularly suitable for protecting the hull of the boat during passage of the boat through locks. The fender comprises a sealed, flexible, fluidtight bag formed from two elongated sheets of flexible fluidtight material sealed together about their peripheries and having a transverse seal which forms first and second sealed compartments. The transverse seal is located closer to one end of the bag than the other. First and second ports are respectively provided in the first and second compartments for admitting air to the first compartment and for admitting a heavier substance such as water to the second compartment. Upon inflation, the inflated thickness of the first compartment is greater than the inflated thickness of the second compartment so that the first compartment, which contains the air, is capable of absorbing the shock between the boat hull and the wall of the lock, while the second compartment is protected against abrasion between the lock wall and the hull by the thickness of the air-filled first compartment. The liquid compartment serves to weight the bag so that it is not blown about and so that it retains its protecting position with respect to the hull.

3 Claims, 3 Drawing Figures

BOAT FENDER

BACKGROUND OF THE INVENTION

This invention relates to boat fenders, and more particularly to bags which are suitable for protecting the hull of a boat during passage through locks.

It is quite common for boat owners to provide makeshift boat fenders by filling burlap sacks with straw and lowering those bags by ropes over the side to a proper fending position for the hull of the craft. However, those bags become water-laden and are quite bulky to store on the boat. Improvised rubber articles, such as old tires and blocks of rubber, have been employed, but those articles are also bulky to store and tend to mark the hull of the boat. Further attempts to provide fenders include the use of inflatable plastic bags which are lowered over the side to a suitable position on the hull. However, those bags tend to blow back on deck and do not serve their intended purpose. One significant advantage of those bags, however, is that they can be deflated and easily stored.

SUMMARY OF THE INVENTION

This invention provides a boat fender which is particularly suitable for protecting the hull of a boat during locking operations, which includes the advantages of prior art fenders but which has none of the disadvantages. The fender according to this invention comprises a sealed, flexible, fluidtight bag formed from two elongated sheets of flexible fluidtight material sealed together about their peripheries and having a transverse seal which forms first and second sealed compartments. The second compartment is smaller than the first, and each compartment includes its own access port for admitting air to the larger first compartment and a heavier substance, such as water, to the second compartment. The inflated thickness of the first compartment is greater than the inflated thickness of the second compartment so that the bulkier air-containing first compartment may be compressed between the side of the lock and the hull while the smaller water-filled compartment serves solely as a weight to prevent the fender from being blown about, and is not subjected to abrasion between the side of the lock and the hull of the boat.

DETAILED DESCRIPTION OF THE INVENTION

Figure 1:
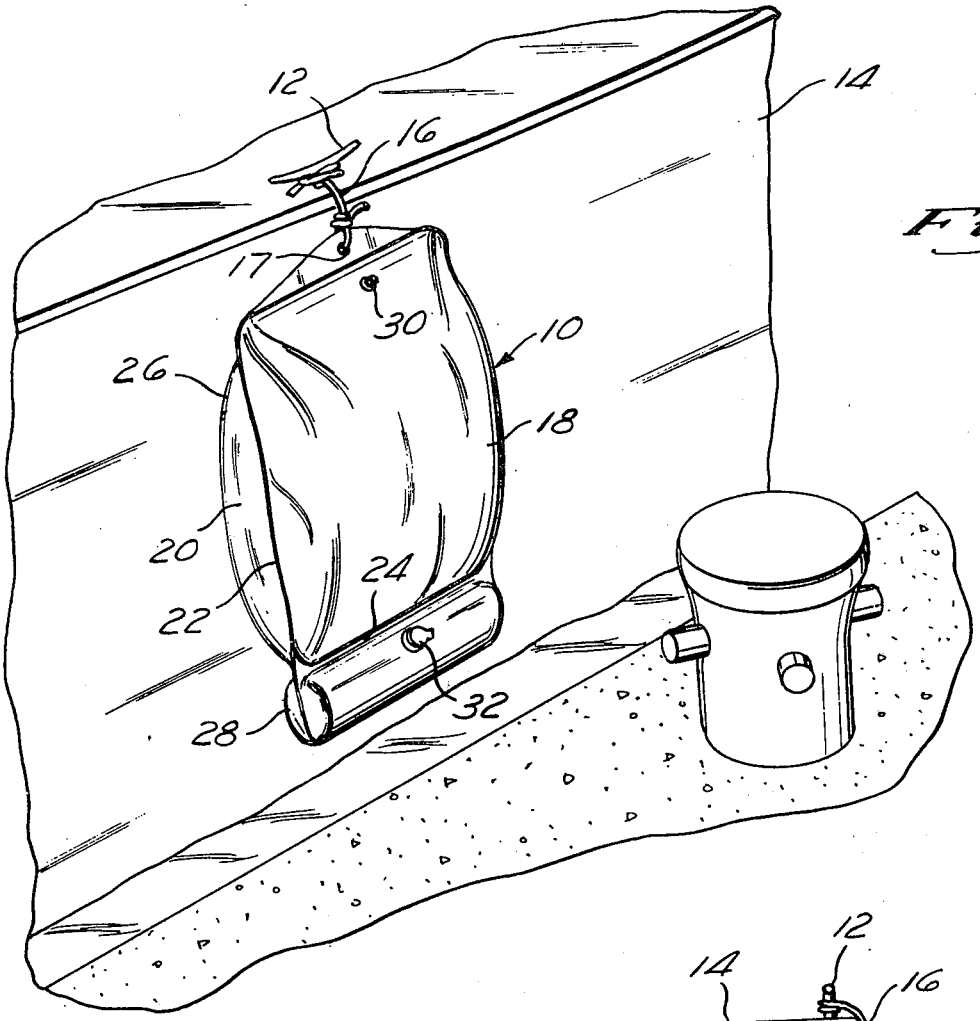
FIG. 1 is a fragmentary, perspective view of a boat fender in accordance with this invention, showing the fender in a suspended position against the side of a boat hull.
Figure 2:
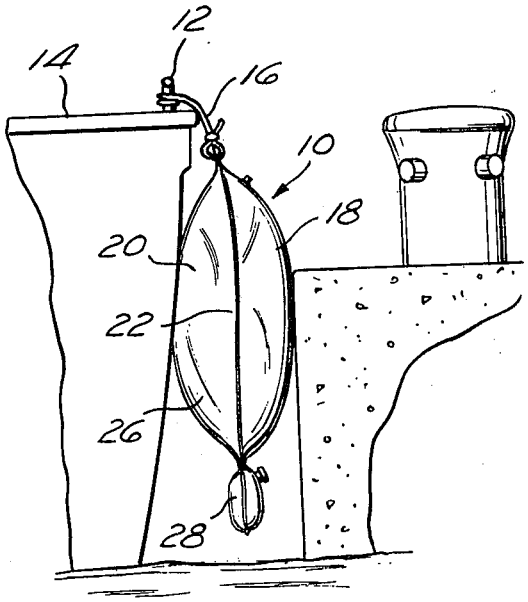
FIG. 2 is a fragmentary, elevational view, showing the suspended boat fender being compressed between the hull of a boat and the wall of a lock.
Figure 3:
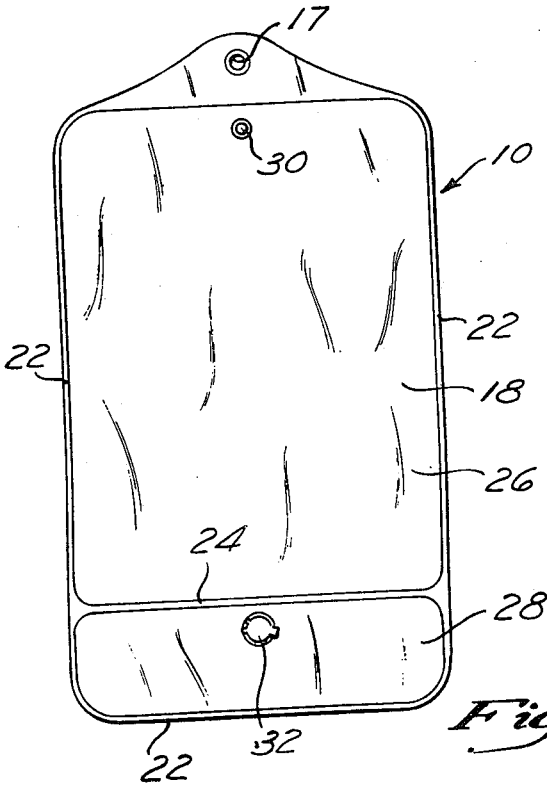
FIG. 3 is an elevational view of the boat fender in a deflated, flat condition.

Referring now to the drawing, there is disclosed an inflatable, weighted boat fender 10 which in FIGS. 1 and 2 is illustrated as being tied to a cleat 12 of a boat 14 by a line 16 which passes through a grommet 17 in the boat fender 10. The fender comprises a sealed, flexible, fluidtight bag formed from two elongated sheets 18 and 20 of flexible, fluidtight material, such as vinyl, heat-sealed together about their peripheries 22. A transverse heat seal 24 is provided closer to one end of the bag 10 than the other to provide first and second closed chambers 26 and 28, respectively. A port 30 provides access to the first sealed chamber 26 and is preferably a conventional tire-inflating valve. A port 32 provides access to the second sealed chamber 28 and is preferably a conventional plastic pop-open cap. Air may be admitted to the first chamber 26 to inflate it to the condition illustrated in FIGS. 1 and 2, and a heavier substance, such as water, is admitted to the second chamber 28 so that the bag 10 is weighted and is not blown to a nonfending position by the wind.

As may be seen most clearly in FIG. 2, the inflated thickness of the second chamber 28 is less than the inflated thickness of the first chamber 26. This feature prevents the compression of the second chamber 28 between the boat hull and the lock, since any such compression may cause the second chamber to burst, due to the incompressible fluid contained therein.

The invention is not restricted to the slavish imitation of each and every detail set forth above. Obviously, devices may be provided which change, eliminate, or add certain specific details without departing from the scope of the invention.

What is claimed is:

1. An inflatable, weighted boat fender which is particularly suitable for protecting the hull of the boat during locking operations, comprising a sealed, flexible, fluidtight bag formed from two elongated sheets of flexible fluidtight material sealed together about their peripheries and having a transverse seal which forms first and second sealed compartments, said transverse seal being located closer to one end of the bag than the other, first and second port means respectively provided in said first and second sealed compartments for admitting air to said first compartment and for admitting a heavier substance to said second compartment, the inflated thickness of said first compartment being greater than the inflated thickness of said second compartment.

2. An inflatable, weighted boat fender according to claim 1, wherein said bag is rectangular and has an eyelet formed at its upper edge.

3. An inflatable, weighted boat fender according to claim 2, wherein said transverse seal is parallel to the shorter sides of said rectangular bag.

* * * * *